US005138917A

United States Patent [19]

Kirschner

[11] Patent Number: 5,138,917

[45] Date of Patent: Aug. 18, 1992

[54] HOLDER FOR CHISEL AND THE LIKE

[76] Inventor: Ronald D. Kirschner, 106 Marley Pl., London, Ontario, Canada, N6C 3T3

[21] Appl. No.: 735,545

[22] Filed: Jul. 19, 1991

[51] Int. Cl.[5] ..... B25B 5/10

[52] U.S. Cl. ..... 81/487; 81/164

[58] Field of Search ..... 81/487, 164, 175, 176, 81/158

[56] References Cited

U.S. PATENT DOCUMENTS

| | | | |
|---|---|---|---|
| 221,633 | 11/1879 | Vinton | 81/164 |
| 804,008 | 11/1905 | Hopkins | 81/164 |
| 1,608,432 | 11/1926 | Ryan | 81/164 |
| 2,506,373 | 5/1950 | McClain | 81/487 |
| 2,589,075 | 3/1952 | Gravis | 81/487 |
| 3,318,176 | 5/1967 | Geier, Jr. | 81/164 |
| 4,554,944 | 11/1985 | Dage | 81/176 |

FOREIGN PATENT DOCUMENTS

| | | | |
|---|---|---|---|
| 0007317 | of 1889 | United Kingdom | 81/175 |

*Primary Examiner*—Roscoe V. Parker
*Attorney, Agent, or Firm*—Mitches & Co.

[57] ABSTRACT

A tool holder for holding a chisel or the like includes a fixed jaw member, generally in the shape of the letter C, wherein one arm of the C has an apex communicating with the center of the C and the other arm thereof defines a threaded aperture whose longitudinal axis intersects the apex and a threaded shaft is adapted to travel and threadingly mate with the threaded aperture to bear against the perimeter of a tool that is circular or hexagonal and to urge the tool against the apex, the arms defining a channel or space therein which acts as a sighting channel for the user, on the one hand, and a passageway for easy removal and insertion of the tool, on the other hand. The threaded shaft extends into a resilient handle that absorbs shock.

5 Claims, 1 Drawing Sheet

HOLDER FOR CHISEL AND THE LIKE

This invention relates to a tool holder, specifically to a hand-held holder for hand-held tools.

BACKGROUND TO THE INVENTION

It is common, when using a hand-held chisel and hitting it with a mallet hammer or the like, that if due care is not used, one may not strike the chisel head but instead, hit one's hand that is holding the chisel and hurt or damage the same to a great extent.

It is an object of the invention to provide a tool holder which may be held by the hand, disposing the hand at a pre-determined and safe distance away from the tool while the holder holds the tool which is to be struck with a hammer.

As a further object of the invention, that the tool he provided with a flexible means so that any vibraton impacted on the tool by hammer and the like is not transmitted to one's hand.

It is a further object to provide a channel means through the holder that on the one hand, facilitates easier removal and insertion of the tool into the holder and advantageously provides a sighting or view channel for viewing the tip of the chisel or tool, from above, while hammering it.

SUMMARY OF THE INVENTION

A tool holder for holding a chisel or the like includes a fixed jaw member, generally in the shape of the lette C, wherein one arm of the C has an apex communicating with the center of the C and the other arm thereof defines a threaded aperture whose longitudinal axis intersects the apex and a threaded shaft is adapted to travel and threadingly mate with the threaded aperture to bear against the perimeter of a tool that is circular or hexagonal and to urge the tool against the apex, the arms defining a channel or space therein which acts as a sighting channel for the user, on the one hand, and a passageway for easy removal and insertion of the tool, on the other hand. The threaded shaft extends into a resilient handle means that absorbs shock.

The invention therefore contemplates a tool holder for holding a chisel and the like comprising a fixed jaw member generally shaped in the form of the letter C defining an open center region and having a proximate end and a distal end and an apex near the distal end communicating with the central region, the space between the ends defining a passageway comunicating with the centre region, the jaw having a base portion integral therewith which makesof the fixed jaw, the jaw carrying a base piece integral therewith which makes communication with the proximate end and defines therein a threaded aperture, the longitudinal axis of which lies in a prolongation that intersects the apex, a threaded shaft adapted to threadingly mate and to travel through the threaded aperture, said shaft having a distal bearing face; and, a flexible cylindrical handle means affixed to the threaded shaft whereby the threaded shaft adapted to be turned down and to have the bearing face abut and engage a tool body so as to confine the tool body between said apex and said bearing face. In the preferred embodiment, the prolongation of the longitudinal axis subtends an angle of 60°.

BRIEF DESCRIPTION OF DRAWINGS

The invention will now be described by way of example and by way of the accompanying drawings in which.

DESCRIPTION OF THE PREFERRED EMBODIMENT

Figure 1:
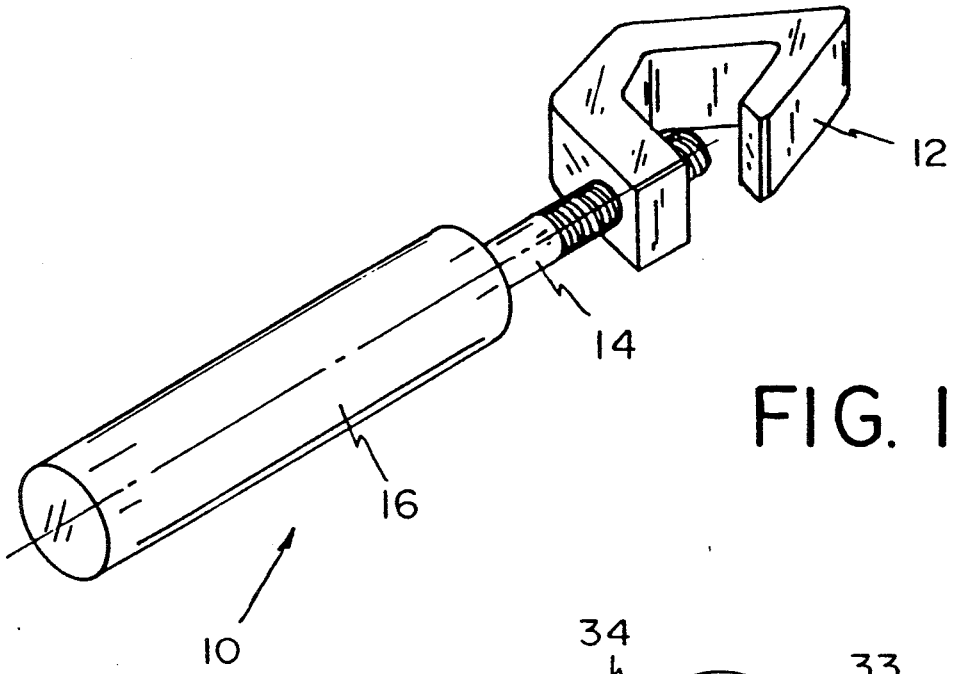
FIG. 1 is a perspective view of the embodiment.

The invention contemplates a tool holder 10 comprising an open fixed jaw member 12, a threaded shaft portion 14 adapted to thread through threads defined by the fixed jaw 12, and a resilient, cylindrical handle 16. A chisel 20, or the like, whether hexagonal or circular in cross-section, is held within the confines of the fixed jaw in the manner shown in FIG. 2. When a hammer H, mallet or other device is used to hit the chisel head in the direction of arrows shown in FIG. 3, the tool and the tool holder may vibrate in response to the hitting, since the tool holder is rigidly attached to the tool 20, but the user's hand h is unaffected by the vibration V caused by the tool impacting on the concrete surface or the like, S which is being removed.

Figure 2:
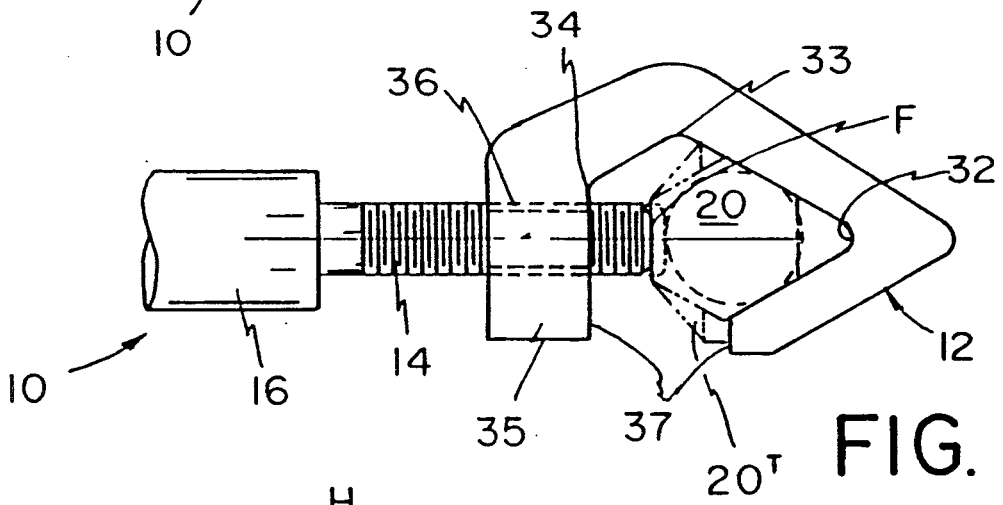
FIG. 2 is a partial top elevation of the embodiment of FIG. 1, when in application.

The jaw 12 is formed from steel and defines an inner distal apex 32 at 60°, a lateral or side apex 33 of approximately 120° and a base angle 34 of approximately 130°. The jaw 12 has an integral base piece 35 and defines a tool accomodating aperture 37 through which the tool 20 may be moved for insertion into or removal from the tool holder in a simplistic fashion. The aperture 37 also acts as a sighting channel to view the chisel tip $\mathbf{20}^T$ when in the top plan view, as seen in FIG. 2. This allows top viewing of the tool and the impact surface S against which the tool tip engages at each hammering interval.

The base 35 defines a threaded aperture through which the threaded shaft 14 threadably extends so as to urge down upon the perimeter of the tool 20 and to clasp the same against the bifurcate inner margin of the tool holder that is subtended by apex 32. The diameter of the shaft 14 is perferably about ⅝ths of an inch, fine thread, and the diameter of the resilient cylindrical handle 16, about 1¼ of an inch, while the length is about 6 or more inches, depending upon the requirements of the user. These measurements allow for easy twisting of the handle and threadingly engaging the distal face F of the threaded shaft against the tool or chisel 20. In order to further reduce any tendency to back-loosen, the threaded shaft may have a linear nylon patch deposit thereon to provide extra frictional engagement with the thread of the threaded aperture in the base 35.

Preferably, the prolongation of the longitudinal axis of the shaft 14 intersects the apex 32 and preferably, bisects it.

Figure 3:
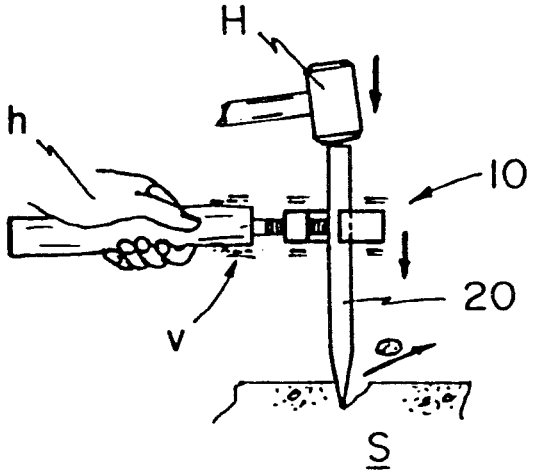
FIG. 3 is a perspective view of the tool holder in application.

In use and referring to FIG. 3, when the hammer H hits the tool, the tool holder 10 vibrates with the tool 20 save and except, due to the flexible handle 16, shock is not transmitted to the hand h.

Those skilled in the art will appreciate that variations to the invention can be achieved without substantially or materially deviating from the invention as claimed.

I claim:

1. A tool holder, for holding a longitudinal tool body such as a polygonal shaft of a hand holdable cold chisel, comprising:

(a) a fixed jaw member generally shaped in the form of the letter C defining an open center region and having a proximate end and a distal end and an apex near the distal end communicating with the central region, the space between the ends defining a passageway communicating with the centre region, the jaw having a base portion integral with the fixed jaw, the jaw carrying a base piece integral therewith which makes communication with the proximate end and defines therein a threaded aperture, the longitudinal axis of which lies in a prolongation that intersects the apex;

(b) a threaded shaft adapted to threadingly mate and to travel through the threaded aperture, said shaft having a distal bearing face; and, (c) a yieldable cylindrical handle means affixed to the threaded shaft whereby the threaded shaft is adapted to be turned down by the yieldable cylindrical handle means and to have the bearing face abut and engage a portion of the tool body so as to confine it between said apex and said bearing face.

2. The tool holder as claimed in claim 1, wherein the prolongation of said longitudinal axis bisects the apex.

3. The tool holder as claimed in claim 1, wherein the apex is 60°.

4. The holder as claimed in claim 2, wherein the apex is 60°.

5. The holder as claimed in claim 1, wherein the threaded shaft has a nylon patch deposit therealong which acts as friction means between said threaded aperture and said threaded shaft.

* * * * *